US007770614B2

(12) United States Patent
Ben Shlomo et al.

(10) Patent No.: US 7,770,614 B2
(45) Date of Patent: Aug. 10, 2010

(54) FUNNEL SYSTEM

(75) Inventors: Tal E. Ben Shlomo, Ramat Hasharon (IL); Itamar Burstein, Tel Aviv (IL)

(73) Assignee: Golden GT LLC., Skokie, IL (US)

( * ) Notice: Subject to any disclaimer, the term of this patent is extended or adjusted under 35 U.S.C. 154(b) by 854 days.

(21) Appl. No.: 11/703,842

(22) Filed: Feb. 8, 2007

(65) Prior Publication Data

US 2008/0190517 A1 Aug. 14, 2008

(51) Int. Cl.
*B65B 1/04* (2006.01)

(52) U.S. Cl. ..... 141/344; 141/1

(58) Field of Classification Search ..... 141/1, 141/95, 199–205, 297–300, 331–345
See application file for complete search history.

(56) References Cited

U.S. PATENT DOCUMENTS 954,161 A * 4/1910 Best ..... 141/337
1,094,350 A * 4/1914 Walter ..... 141/345
D245,344 S 8/1977 Fisher
4,600,125 A 7/1986 Maynard, Jr.
5,228,488 A * 7/1993 Fletcher ..... 141/331
D348,275 S 6/1994 Zimmerman
6,739,363 B2 5/2004 Walter et al.

OTHER PUBLICATIONS

U.S. Appl. No. 29/272,421, filed Feb. 2007, Ben Shlomo, Tal E. et al.

* cited by examiner

*Primary Examiner*—Gregory L Huson
*Assistant Examiner*—Jason K Niesz
(74) *Attorney, Agent, or Firm*—Pearl Cohen Zedek Latzer, LLP

(57) ABSTRACT

A funnel system and method for introducing and dispensing a material are presented. In this funnel system two frusto-conical devices having intake ports which have a larger diameter than the diameter of their exit ports may be mated. When mated, a passage exists through the devices' exit ports. Both frusto-conical devices may have partially eclipsed exit ports such that when one device rotates with respect to the other, the passage throttles between a substantially open and a substantially closed position. In this method the devices may be rotated such that the passage may be in the substantially closed position and a material may then be introduced into the second device's intake port. To dispense the material, the devices may be rotated such that the passage may be in a substantially open position whereupon the material may be dispensed from the first device's exit port.

20 Claims, 6 Drawing Sheets

FUNNEL SYSTEM

BACKGROUND OF THE INVENTION

1. Field of the Invention

The present invention generally relates to a funnel system for directing the flow of material such as liquids or granular solids from a first container to a second container. More specifically, the present invention relates to a funnel system which holds material from a first container and may prevent the flow of the material to the second container.

2. Description of the Related Art

When cooking, it is often necessary to measure materials or pour materials from one container to another container. Although several methods exist to perform these tasks, none are ideal. One such method would be to first pour the material from the first container into a measuring cup to ensure the proper amount of material and to then pour the material from the measuring cup into a second container. Even if the measuring cup has a spout, it is difficult to ensure that all of the material flows into the second container without spilling. This is especially true if the second container has a narrow opening. A second method further improves the first method by employing a funnel which is inserted into the second container. Instead of pouring the material directly from the measuring cup, the material may be poured from the measuring cup to the funnel thus ensuring that none of the material spills. However, this method requires the purchase, storage, and cleaning of two separate pieces of equipment.

SUMMARY OF THE INVENTION

A funnel system may include a first hollow frusto-conical device having an intake port and an exit port, wherein a diameter of the exit port may be smaller than a diameter of the intake port The funnel system may further include a second hollow frusto-conical device having an intake port and an exit port, wherein a diameter of the exit port may be smaller than a diameter of the intake port, and wherein the second device may be adapted for mating with the first device for forming a passage from the second device through the first device, wherein the exit ports may be partially eclipsed so that when the second device rotates with respect to the first device the passage throttles between a substantially open position and a substantially closed position.

A method for introducing and dispensing a material may include providing a first hollow frusto-conical device having an intake port and an exit port, wherein a diameter of the exit port may be smaller than a diameter of the intake port. The method may further include providing a second hollow frusto-conical device having an intake port and an exit port, wherein a diameter of the exit port may be smaller than a diameter of the intake port, and wherein the second device may be adapted for mating with the first device for forming a passage from the second device through the first device, wherein the exit ports are partially eclipsed so that when the second device rotates with respect to the first device the passage throttles between a substantially open position and a substantially closed position. The method may further include rotating the second hollow frusto-conical device relative to the first hollow frusto-conical device for throttling the passage to the substantially closed position. The method may further include introducing the material into the intake port of the second hollow frusto-conical device. The method may further include rotating the second hollow frusto-conical device relative to the first hollow frusto-conical device for throttling the passage to the substantially open position. The method may further include dispensing the material from the exit port of the first hollow frusto-conical device.

A funnel system may include a first funnel, including an intake port and an exit port, wherein a diameter of the exit port may be smaller than a diameter of the intake port. The funnel system may further include a second funnel adapted to mate with and operably rotate with respect to the first funnel, including an intake port and an exit port, wherein a diameter of the exit port may be smaller than a diameter of the intake port. The funnel system may further include a passage through the exit ports. The funnel system may further include a first occluding member disposed within the exit port of the first funnel, wherein the first occluding member partially eclipses the exit port of the first funnel. The funnel system may further include a second occluding member disposed within the exit port of the second funnel, wherein the second occluding member partially eclipses the exit port of the second funnel, and wherein when the second funnel rotates with respect to the first funnel the passage throttles between a substantially open position and a substantially closed position.

DESCRIPTION OF THE DRAWINGS

Various embodiments of the present invention are illustrated in the following drawings, which are meant to be exemplary only and are not limiting on the scope of the present invention, and in which.

DESCRIPTION OF THE PREFERRED EMBODIMENT

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention.

Figure 1:
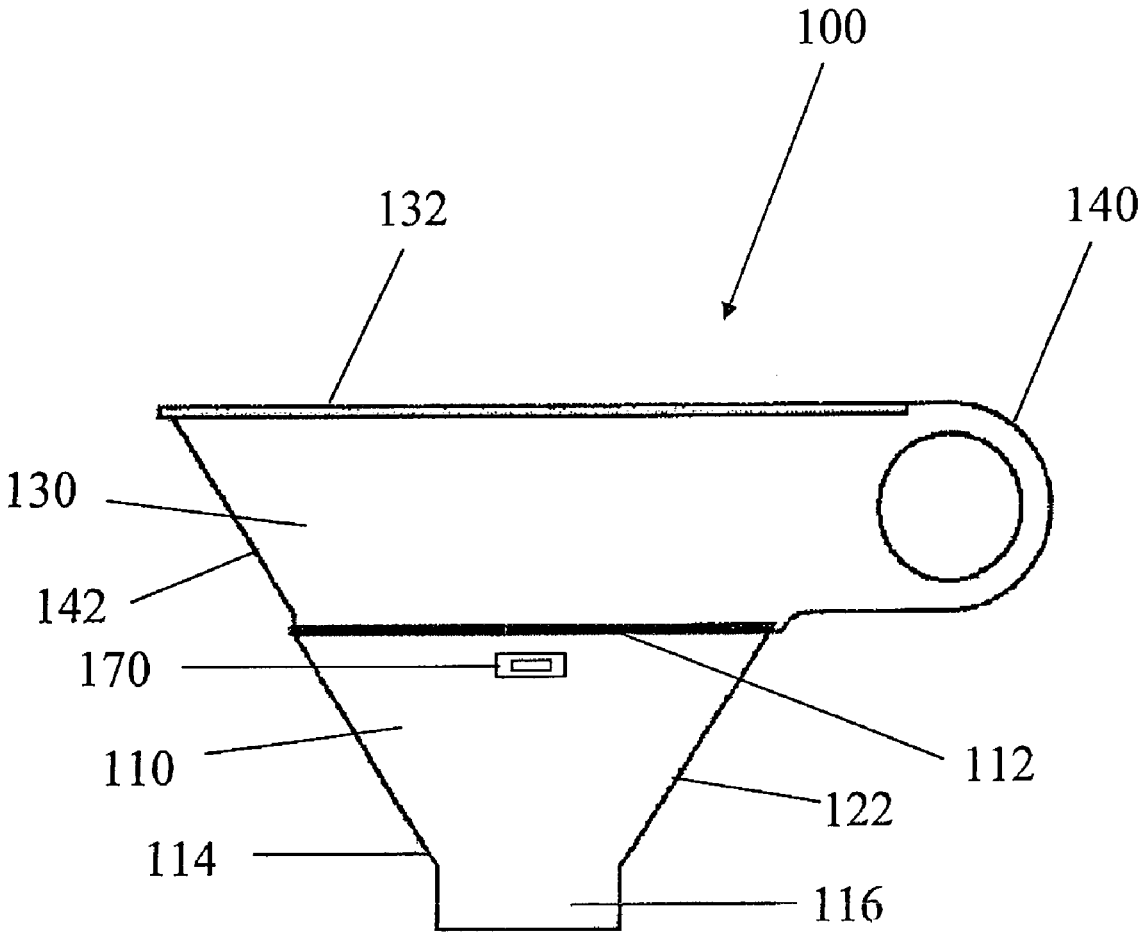
FIG. 1 is a side view drawing of a funnel system in accordance with one embodiment of the present invention.

A side view drawing of an embodiment of funnel system 100 is shown in FIG. 1. Other views are shown in FIGS. 2-5. The funnel system 100 is generally constructed of two separable devices, for example, a first hollow frusto-conical device 110 and a second hollow frusto-conical device 130. The first hollow frusto-conical device 110 is comprised of side walls 122 which taper from an intake port 112 and which lead to an exit port 114. The diameter of the exit port 114 is smaller than the diameter of the intake port 112. The first hollow frusto-conical device 110 may also have a depending cylindrical member 116 which may lead from the exit port 114. The second hollow frusto-conical device 130 is comprised of side walls 142 which taper from an intake port 132 and which lead to an exit port 134. The diameter of the exit port 134 is smaller than the diameter of the intake port 132.

The second hollow frusto-conical device 130 is adapted for mating with hollow frusto-conical device 110. In a preferred embodiment of the invention, the side walls 142 of the second hollow frusto-conical device 130 conform to the inner dimensions of the side walls 122 of the first hollow frusto-conical device 110. In this embodiment, the second hollow frusto-conical device 130 fits within first hollow frusto-conical device 110 so that the exit port 134 of the second device 130 sits within the exit port 114 of the first device 110. When the two devices are mated, a passage 160 is created through exit port 134 and exit port 114. The mating between the two devices allows the second hollow frusto-conical device 130 to rotate with respect to the first hollow frusto-conical device 110. In a preferred embodiment of the present invention, when mated, the intake port 132 of the second device may extend beyond the intake port 112 of the first device in a direction distal to the exit ports of both devices. In another embodiment of the present invention, the intake port 132 of the second device may not extend beyond the intake port 112 of the first device.

A locking mechanism 170 shown in FIG. 1 may be used to lock the two hollow frusto-conical devices 110 and 130 in a mated position so that the two devices cannot be separated. However, even in embodiments of the invention that may include a locking mechanism 170, the second hollow frusto-conical device 130 is free to rotate with respect to the first hollow frusto-conical device 110. An unlocking mechanism (which may be incorporated into locking mechanism 170) may also be used when a locking mechanism is employed to unlock the two devices from the mated position and allow their separation.

Figure 4A:
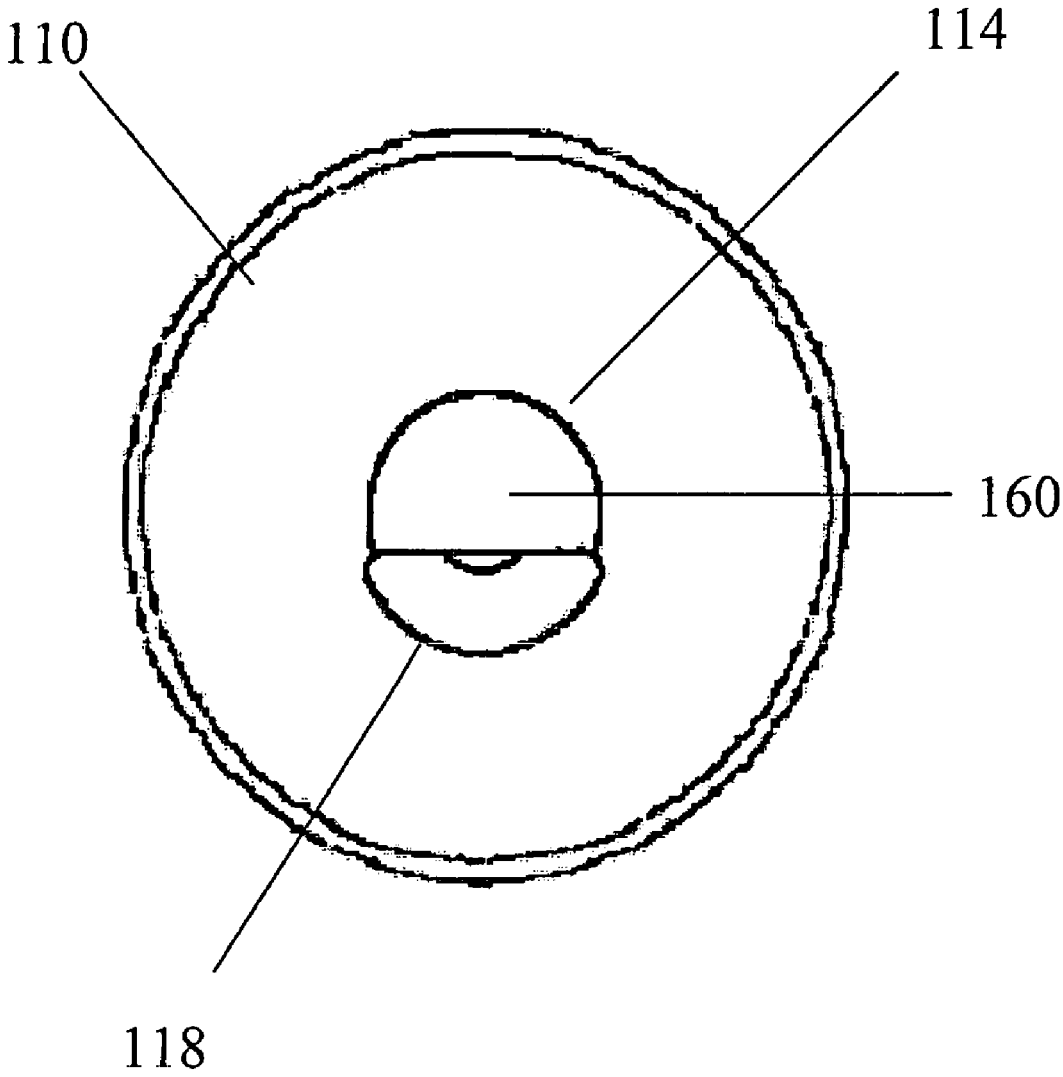
FIG. 4*a* is a top view drawing of a first frusto-conical device in accordance with the funnel system of FIG. 1 and FIG. 2.
Figure 4B:
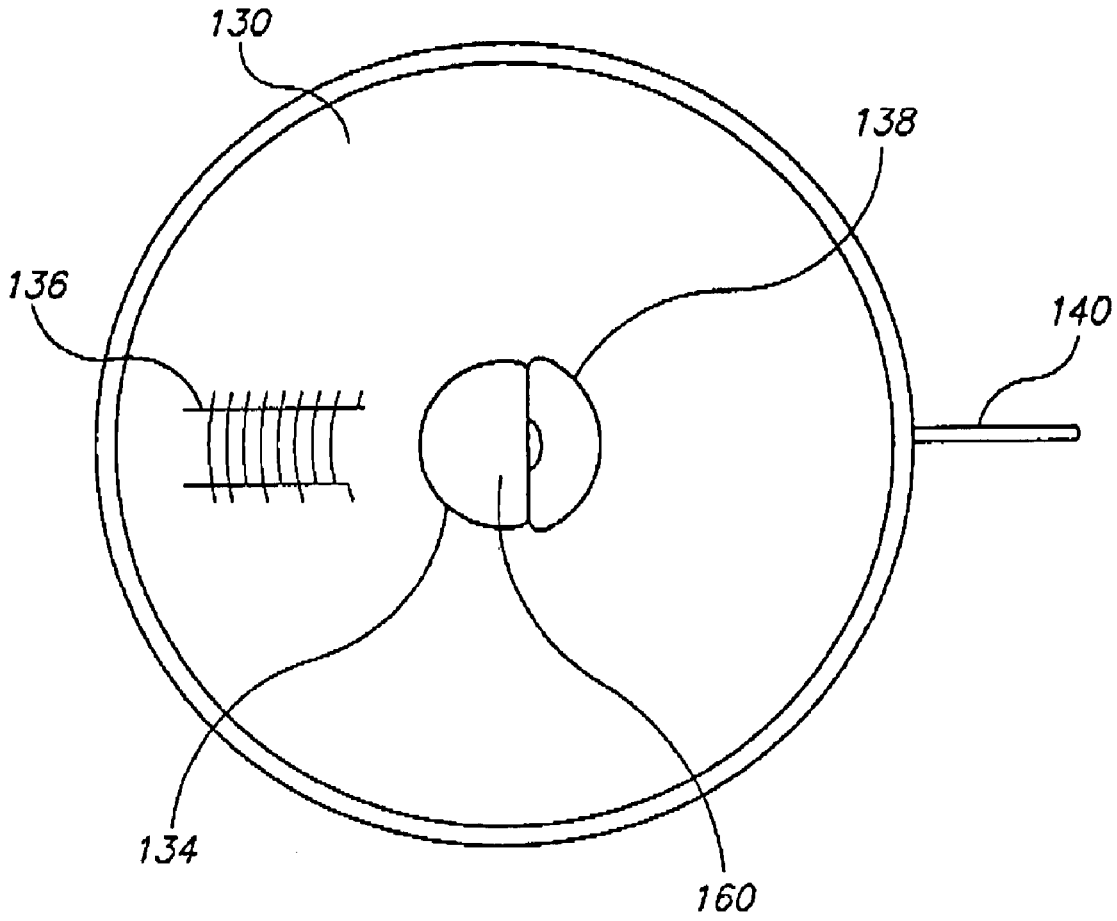
FIG. 4*b* is a top view drawing of a second frusto-conical device in accordance with the funnel system of FIG. 1 and FIG. 2.
Figure 5:
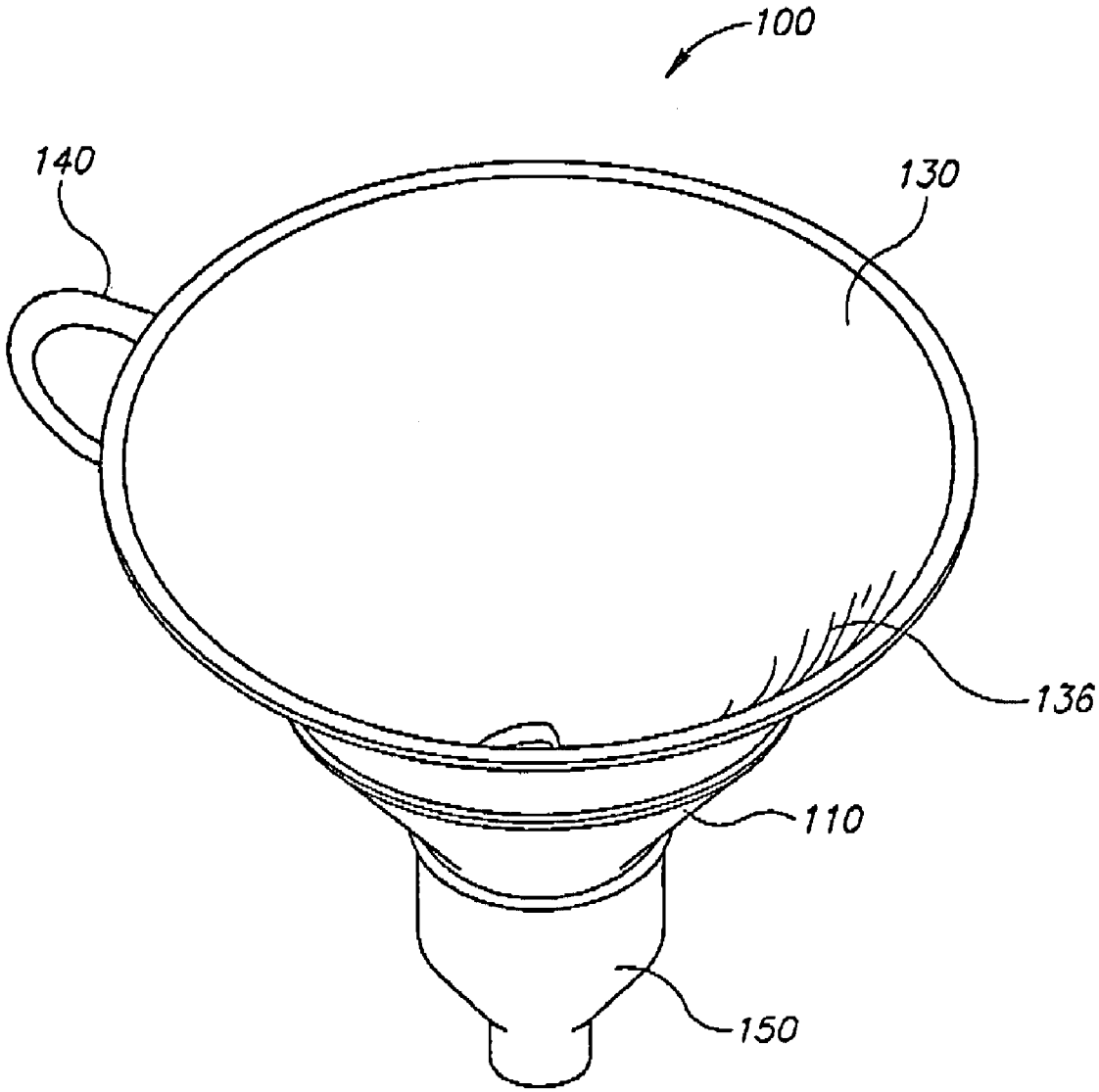
FIG. 5 is an isometric view drawing of the funnel system of FIG. 2.

The exit ports 114 and 134 of the first and second devices further include occluding members 118 and 138 respectively. The occluding members 118 and 138 may be formed integral to their respective exit ports or may alternately be removable. The exit ports 114 and 134 are preferably partially eclipsed by occluding members 118 and 138, respectively. An embodiment of the occluding members is shown in FIGS. 4*a*-4*b*. When the second hollow frusto-conical device 130 is made to rotate with respect to the first hollow frusto-conical device 110, the occluding member 138 also rotates with respect to occluding member 118. During this rotation, the occluding members 118 and 138 are made to cause the passage 160 created between exit ports 114 and 134 to throttle between a substantially open and a substantially closed position. In a preferred embodiment of the present invention, the occluding members 118 and 138 may each be formed as a semi-circular disk. In other embodiments, the occluding members 118 and 138 may be formed into alternate shapes which partially eclipse the exit ports 114 and 134 as is well known to those skilled in the art. In another embodiment, only one occluding member may be used which expands and contracts, or which opens and closes when the two hollow frusto-conical devices are rotated relative to each other. In this way, they may cause the passage 160 to throttle between a substantially open and a substantially closed position.

The second hollow frusto-conical device 130 may further include one or more measuring scale(s) 136. An embodiment of the measuring scale 136 is shown in FIG. 4*b*. The measuring scale 136 may be for example a volumetric scale useful for determining the quantity of material within the funnel system. The measuring scale(s) 136 may be a liquid scale with labels such as teaspoons, tablespoons, ounces, cups, pints, quarts, milliliters, liters, or the like. The measuring scale(s) 136 may alternately or additionally be a solid (or dry) scale with labels such as ounces, pounds, grams, kilograms, or the like in which the scale is based on the density of a particular solid (or dry) material to be measured.

The second hollow frusto-conical device 130 may also include a handle 140. The handle 140 may be used to ease rotating the second hollow frusto-conical device 130 with respect to the first hollow frusto-conical device 110. The handle 140 may also be used for transporting the funnel system 100. The handle 140 may be either solid or may have a through-hole which may be used to hang the funnel system 100 on a hook. The through-hole may also be sized for the finger or fingers of a user. The second hollow frusto-conical device 130 may also have a spout 144 shown in FIG. 3 that may be used for pouring materials from the funnel system 100.

Figure 2:
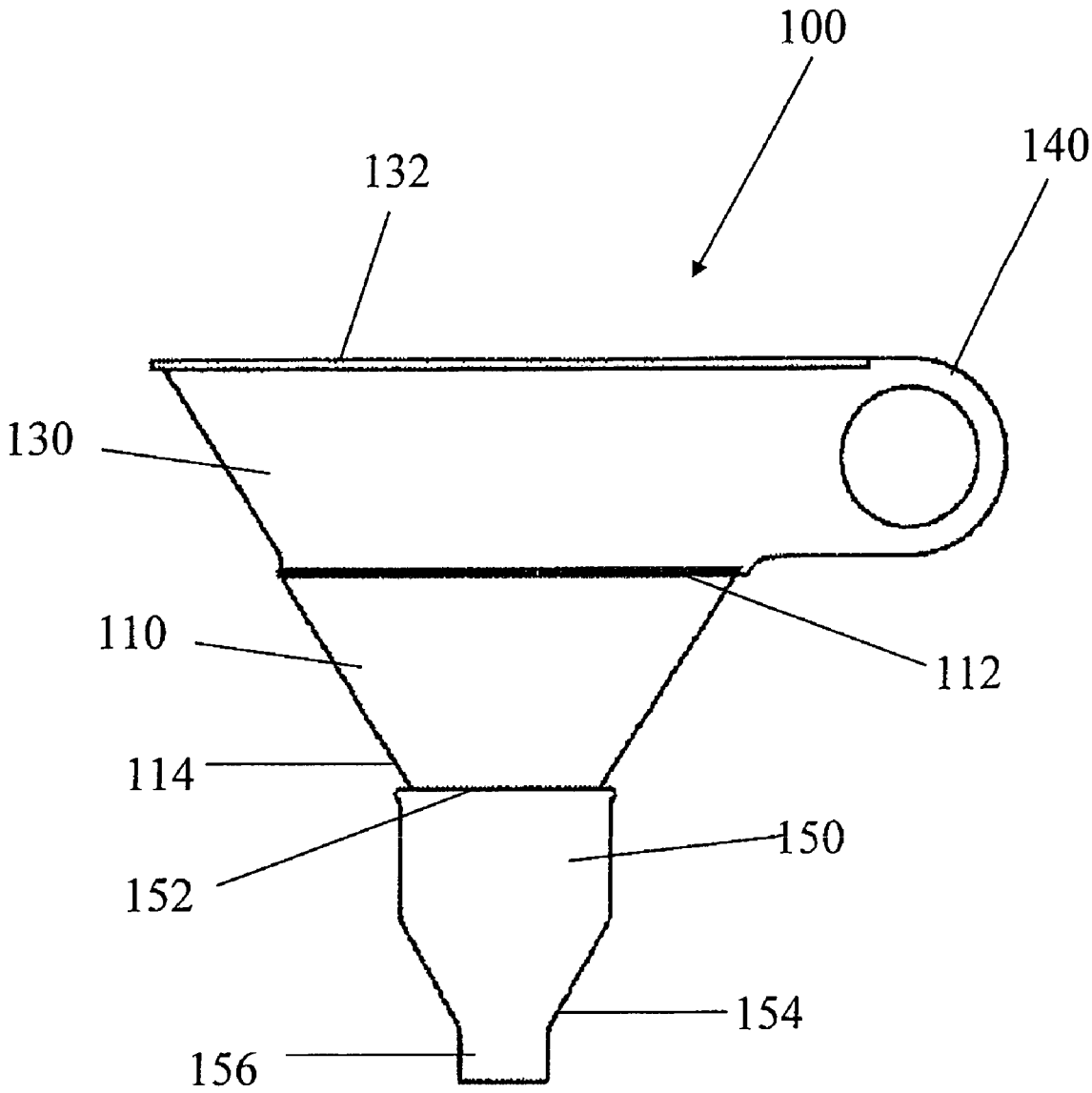
FIG. 2 is a side view drawing of a funnel system with an optional tube attachment in accordance with one embodiment of the present invention.
Figure 3:
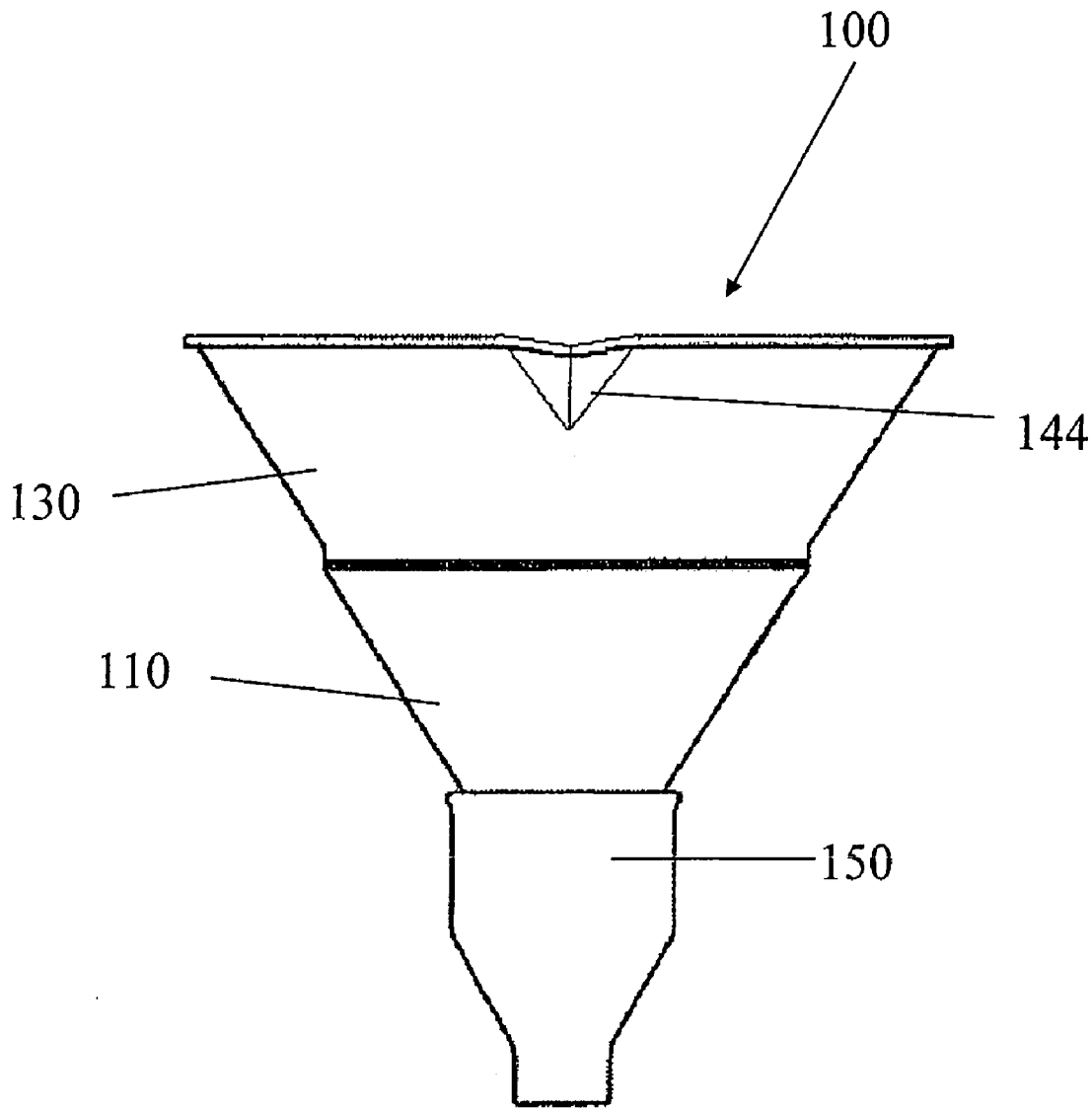
FIG. 3 is a side view drawing of the funnel system of FIG. 2, rotated 90 degrees from FIG. 2.

In some embodiments of the present invention, the funnel system 100 may also include an hollow exit port attachment 150 adapted for mating with exit port 114 of the first hollow frusto-conical device 110. An embodiment of the hollow exit port attachment 150 is shown in FIG. 2. The hollow exit port attachment 150 may be comprised of an intake port 152, an exit port 154, and a depending cylindrical member 156 attached to exit port 154. In some embodiments of the present invention, a locking mechanism (not shown but similar to locking mechanism 170) may be used to lock hollow exit port attachment 150 and first hollow frusto-conical device 110 in a mated position so that the two cannot be separated. An unlocking mechanism (which may be incorporated into the locking mechanism) may also be used when a locking mechanism is employed to unlock the hollow exit port attachment 150 from the first hollow frusto-conical device 110 and allow their separation. In some embodiments of the present invention, the depending cylindrical member 156 may be narrower than the exit port 114 of the first frusto-conical device 110 in order to allow the funnel system 100 to be used with containers having a narrower opening. In other embodiments of the present invention, the depending cylindrical member 156 may be wider than the exit port 114 of the first frusto-conical device 110 in order to allow the funnel system 100 to be used with containers having a wider opening.

The first frusto-conical device 110, the second frusto-conical device 130, and the hollow exit port attachment 150 can be made from a wide variety of materials such as-glass, plastic, ABS, stainless steel, or the like. Further, not all of the components of funnel system 100 need be made from the same materials. For example, the second frusto-conical device 130 may be made of glass and the first frusto-conical device 110 may be made of plastic. Clear materials may be preferred in order to view the volume of the material within the funnel system with measuring scale(s) 136.

The funnel system 100 may be used both to measure a volume of material from a first container and to dispense the material into a second container. In such an embodiment, the first hollow frusto-conical device 110 is first rotated with respect to the second hollow frusto-conical device 130. During this rotation, the passage 160 created between exit ports 114 and 134 is preferably throttled into the substantially closed position. Once the passage 160 is substantially closed, a material such as a liquid or a granular solid, may be introduced into the intake port 132 of the second hollow frusto-conical device 130. Since the passage 160 is substantially closed, the material will remain within the funnel system 100. The material may then be measured using measuring scale(s) 136. Material may then be removed or added to the funnel system 100 based upon whether too much or too little material has been introduced into the funnel system 100. Once the desired measure of material is within the funnel system 100, the exit port 114 of first hollow frusto-conical device 110 may be aligned with the opening of a second container. Optional depending cylindrical member 116 or optional hollow exit port attachment 150 may be used to aid in the alignment of the funnel system 100 if the material contained therein is to be discharged into a container. Once aligned, the first hollow frusto-conical device 110 is rotated with respect to the second hollow frusto-conical device 130. This rotation may be in the same direction as the first rotation or in a different direction. During this second rotation, the passage 160 created between exit ports 114 and 134 is throttled from the substantially closed position to a substantially open position. As the passage 160 is opened, the material within the funnel system is discharged therefrom. For example, it may be introduced into a container by way of the exit port 114 of the first hollow frusto-conical device 110.

Various devices (not shown) which alter the material as it is introduced into the second container may be incorporated into the funnel system. Such devices may be a permanent part of the funnel system 100 or may be optionally attached or interchangeably exchanged. The physical location of these devices will depend upon the device, but they may be incorporated in or attached to exit port 114 or 134, occluding member 118 or 138, hollow cylindrical depending member 116, hollow exit port attachment 150 or other members of the funnel system 100. An exemplary embodiment of such a device is an aerator which introduces air into a material as it exits the funnel system 100. Such a device may be useful for wines or other beverages. Another exemplary embodiment of an additional device may be a strainer which only allows material of a certain dimension to pass through the funnel system 100. Such a device may be useful for creating a sieve or for removing sediment from a liquid. Another exemplary embodiment of such a device is a sifter which may be useful for both aerating a material and allowing material of only a certain dimension to pass through the funnel system 100. Other devices which act upon the material as it exits the funnel system 100 are also possible. Alternately, devices may be employed which act upon the material while still within the funnel system 100. Such devices may include mixers or separators.

Although particular embodiments are shown and described herein, further modifications of the present invention will occur to persons skilled in the art. All such modifications are deemed to be within the scope and spirit of the present invention as defined by the appended claims.

What is claimed is:

1. A funnel system comprising:

a first hollow frusto-conical device having an intake port and an exit port, wherein a diameter of said exit port is smaller than a diameter of said intake port;

a second hollow frusto-conical device having an intake port and an exit port, wherein a diameter of said exit port is smaller than a diameter of said intake port, and wherein said second device is adapted for mating with said first device for forming a passage from said second device through said first device;

wherein said exit ports are partially eclipsed so that when said second device rotates with respect to said first device said passage throttles between a substantially open position and a substantially closed position.

2. The funnel system of claim 1, further comprising a depending cylindrical member leading from said exit port of said first hollow frusto-conical device.

3. The funnel system of claim 1, further comprising a hollow exit port attachment having an intake port and an exit port, wherein said intake port is adapted for attachment with said exit port of said first hollow frusto-conical device and said exit port has a diameter different than said diameter of said exit port of said first hollow frusto-conical device.

4. The funnel system of claim 1, further comprising a measurement scale disposed upon said second hollow frusto-conical device.

5. The funnel system of claim 1, further comprising a handle attached to said second hollow frusto-conical device.

6. The funnel system of claim 1, further comprising a locking mechanism for detachably affixing said first device to said second device when said devices are mated.

7. The funnel system of claim 1, further comprising a spout operably attached to said second device.

8. The funnel system of claim 1, wherein said second device is substantially clear.

9. The funnel system of claim 1, wherein said exit ports are partially eclipsed by a first occluding member disposed within said exit port of said first device and a second occluding member disposed within said exit port of said second device.

10. A method for introducing and dispensing a material, the method comprising:

providing a first hollow frusto-conical device having an intake port and an exit port, wherein a diameter of said exit port is smaller than a diameter of said intake port;

providing a second hollow frusto-conical device having an intake port and an exit port, wherein a diameter of said exit port is smaller than a diameter of said intake port, and wherein said second device is adapted for mating with said first device for forming a passage from said second device through said first device, wherein said exit ports are partially eclipsed so that when said second device rotates with respect to said first device said passage throttles between a substantially open position and a substantially closed position;

rotating said second hollow frusto-conical device relative to said first hollow frusto-conical device for throttling said passage to said substantially closed position;

introducing the material into said intake port of said second hollow frusto-conical device;

rotating said second hollow frusto-conical device relative to said first hollow frusto-conical device for throttling said passage to said substantially open position;

dispensing the material from said exit port of said first hollow frusto-conical device.

11. The method of claim 10, further comprising a step of measuring the material within said second hollow frusto-conical device.

12. The method of claim 11, further comprising a step of providing a measuring scale disposed upon said second device for measuring the material within said second hollow frusto-conical device.

13. The method of claim 10, further comprising a step of providing a first and a second occluding member for partially eclipsing said exit ports, wherein said first occluding member is disposed within said exit port of said first device and said second occluding member is disposed within said exit port of said second device.

14. A funnel system, comprising:

a first funnel, comprising an intake port and an exit port, wherein a diameter of said exit port is smaller than a diameter of said intake port;

a second funnel adapted to mate with and operably rotate with respect to said first funnel, comprising an intake port and an exit port, wherein a diameter of said exit port is smaller than a diameter of said intake port;

a passage through said exit ports;

a first occluding member disposed within said exit port of said first funnel, wherein said first occluding member partially eclipses said exit port of said first funnel;

a second occluding member disposed within said exit port of said second funnel, wherein said second occluding member partially eclipses said exit port of said second funnel; and wherein when said second funnel rotates with respect to said first funnel said passage throttles between a substantially open position and a substantially closed position.

15. The funnel system of claim 14, further comprising a hollow exit port attachment having an intake port and an exit port, wherein said intake port is adapted for attachment with said exit port of said first funnel and said exit port has a diameter different than said diameter of said exit port of said first funnel.

16. The funnel system of claim 14, further comprising a measurement scale disposed upon said second funnel.

17. The funnel system of claim 14, further comprising a handle attached to said second funnel.

18. The funnel system of claim 14, further comprising a locking mechanism for detachably affixing said first funnel to said second funnel when said funnels are mated.

19. The funnel system of claim 14, further comprising a spout operably attached to said second funnel.

20. The funnel system of claim 14, wherein said second funnel is substantially clear.

* * * * *